US010805721B2

(12) United States Patent
Choi et al.

(10) Patent No.: US 10,805,721 B2
(45) Date of Patent: Oct. 13, 2020

(54) APPARATUS AND METHOD FOR PREVENTING RECORDING OF ELECTRONIC DEVICES

(71) Applicant: ELECTRONICS AND TELECOMMUNICATIONS RESEARCH INSTITUTE, Daejeon (KR)

(72) Inventors: Chi Hoon Choi, Busan (KR); Ji Eun Choi, Daejeon (KR); Young Jun Lee, Sejong-si (KR); Heesun Park, Sejong-si (KR); Young Hyoun Kwon, Daejeon (KR); Sae-Hoon Ju, Daejeon (KR); Kyung-Hoon Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 85 days.

(21) Appl. No.: 16/254,680

(22) Filed: Jan. 23, 2019

(65) Prior Publication Data

US 2020/0228897 A1 Jul. 16, 2020

(30) Foreign Application Priority Data

Mar. 5, 2018 (KR) ..... 10-2018-0025660

(51) Int. Cl.
*H04R 3/00* (2006.01)

(52) U.S. Cl.
CPC ..... *H04R 3/007* (2013.01); *H04R 3/00* (2013.01)

(58) Field of Classification Search
CPC ..... G10K 11/175; H04R 3/007; H04R 3/00
(Continued)

(56) References Cited

U.S. PATENT DOCUMENTS 8,693,710 B2 * 4/2014 Chu ..... H03G 3/34 381/163
10,068,564 B2 9/2018 Kim
(Continued)

FOREIGN PATENT DOCUMENTS

JP 2010-063272 A 3/2010
KR 10-0731816 B1 6/2007
(Continued)

*Primary Examiner* — David L Ton
(74) *Attorney, Agent, or Firm* — LRK Patent Law Firm

(57) ABSTRACT

An apparatus and method for preventing an electronic device from recording. The apparatus includes a control unit for generating a first modulation signal and controlling the components of the apparatus; a first modulation unit for modulating the first modulation signal to an FM signal; an ultrasonic signal generation unit for generating an ultrasonic signal, the frequency of which is adjusted by changing the value of at least one of a variable resistor and a variable capacitor depending on the magnitude of the FM signal; an amplification unit for increasing or decreasing the magnitude of the ultrasonic signal; a resonance unit for increasing the voltage to be applied to a transducer by generating resonance; and an ultrasound output unit for converting electrical signals into ultrasonic signals using the transducer and radiating a recording prevention signal, converted into the ultrasonic signal, to the microphone of an electronic device.

20 Claims, 13 Drawing Sheets

(58) Field of Classification Search
USPC ..... 381/56
See application file for complete search history.

(56) References Cited

U.S. PATENT DOCUMENTS

| | | | | |
|---|---|---|---|---|
| 2009/0093211 | A1* | 4/2009 | Chu | H04K 3/825 455/1 |
| 2012/0053931 | A1* | 3/2012 | Holzrichter | H04K 3/45 704/200.1 |
| 2018/0068647 | A1* | 3/2018 | Kim | G10K 15/02 |
| 2018/0277086 | A1* | 9/2018 | Soffer | G10K 11/175 |
| 2020/0043458 | A1* | 2/2020 | Fong | G10K 11/175 |
| 2020/0045423 | A1* | 2/2020 | Fong | G10K 11/175 |
| 2020/0143788 | A1* | 5/2020 | Azam | G06F 3/167 |

FOREIGN PATENT DOCUMENTS

| | | | | |
|---|---|---|---|---|
| KR | 10-1411141 | B1 | 6/2014 | |
| KR | 10-1526506 | B1 | 6/2015 | |
| KR | 20-2015-0002730 | U | 7/2015 | |
| WO | WO-9838833 | A1 * | 9/1998 | H04K 3/825 |

* cited by examiner

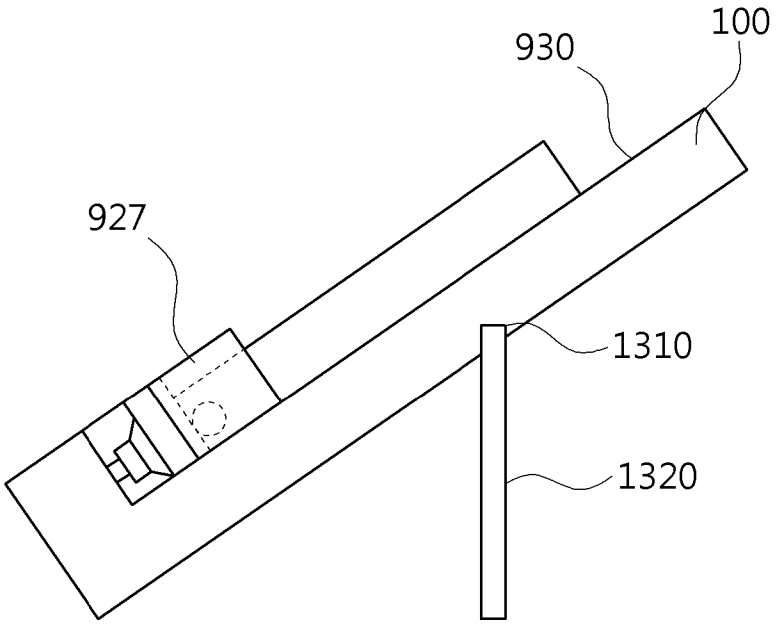
FIG. 13
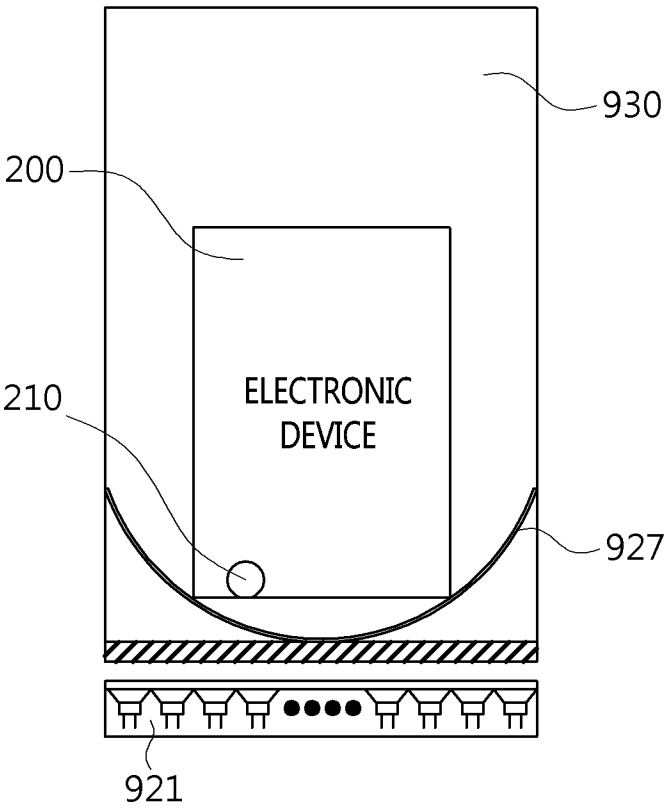

APPARATUS AND METHOD FOR PREVENTING RECORDING OF ELECTRONIC DEVICES

CROSS REFERENCE TO RELATED APPLICATION

This application claims the benefit of Korean Patent Application No. 10-2018-0025660, filed Mar. 5, 2018, which is hereby incorporated by reference in its entirety into this application.

BACKGROUND OF THE INVENTION

1. Technical Field

The present invention relates generally to technology for preventing an electronic device from recording, and more particularly to technology for preventing an electronic device, in which a microphone is embedded, from recording using modulated ultrasound so that a user will not suffer inconvenience.

2. Description of Related Art

In conventional methods for preventing recording, recording is prevented by saturating a microphone with inaudible ultrasound. However, when a filter for blocking inaudible signals is applied at the signal input terminal of the microphone of an electronic device, the conventional methods become ineffective in preventing recording. Also, when an ultrasonic signal that is strong enough to saturate a microphone is continually radiated, although the signal is inaudible to a user, the strong sound pressure thereof may strain hearing and make the user feel tired.

Furthermore, the conventional methods for preventing recording are problematic in that, when a single-tone ultrasonic signal is used to prevent recording, a shadow region, in which the characteristics of ultrasonic waves cause destructive interference, is generated and the recording prevention effect is reduced in the shadow region. In order to solve the problems pertaining to the shadow region, a method of changing the ultrasound frequency has been proposed.

However, an ultrasonic transducer has characteristics in that the most powerful ultrasound is output therefrom when a signal having the unique resonant frequency of the transducer is applied thereto, and in that the signal becomes weaker when a signal, the frequency of which is very different from the unique resonant frequency of the transducer, is applied. Therefore, merely changing the frequency of ultrasound for preventing recording is not sufficient to eliminate a shadow region.

Meanwhile, when a noise signal is generated using multiple modulation methods, the range of a shadow region may be minimized, and recording may be effectively prevented. However, in order to generate a complex noise signal, a circuit structure becomes complicated, and a lot of system resources must be used.

Accordingly, it is necessary to develop technology for generating a complex noise signal using a small and simple circuit structure and thereby applying a recording prevention method without a shadow region.

In connection with this, Korean Patent No. 10-0731816 discloses a technology related to "Eavesdropping prevention method and apparatus using sound wave".

SUMMARY OF THE INVENTION

An object of the present invention is to generate a recording prevention signal only in a narrow area, thereby preventing an electronic device using a microphone from recording within a range in which a user does not feel inconvenience.

Another object of the present invention is to generate an irregular and complex recording prevention signal using a simple circuit structure to thereby prevent an electronic device from analyzing the recording prevention signal.

A further object of the present invention is to effectively eliminate an ultrasound shadow region, which is a limitation of the conventional art.

Yet another object of the present invention is to prevent unilateral recording that is not agreed upon between people who participate in a meeting, telephone conversation, or conversation.

In order to accomplish the above objects, an apparatus for preventing an electronic device from recording according to the present invention includes a control unit for generating a first modulation signal, which is a noise signal source, and controlling the respective components of an apparatus for generating an ultrasonic recording prevention signal; a first modulation unit for modulating the first modulation signal to a frequency-modulated (FM) signal; an ultrasonic signal generation unit for generating an ultrasonic signal, the frequency of which is adjusted in such a way that the value of at least one of a variable resistor and a variable capacitor changes depending on the magnitude of the FM signal; an amplification unit for increasing or decreasing the magnitude of the generated ultrasonic signal; a resonance unit for generating resonance and thereby increasing the voltage to be applied to a transducer; and an ultrasound output unit for converting an electrical signal into an ultrasonic signal using the transducer and radiating a recording prevention signal, which is converted into the ultrasonic signal, to the microphone of an electronic device.

Here, the first modulation unit may perform amplitude modulation (AM) based on information about the frequency of the first modulation signal and may perform the frequency modulation based on information about the amplitude of the first modulation signal.

Here, the resonance unit may control the magnitude of the amplitude modulation by adjusting at least one of the resistance of the resonance unit and the Q factor of the load of the resonance unit.

Here, the first modulation signal may be configured such that at least one of the frequency and the amplitude thereof has a random value.

Here, the apparatus may further include a second modulation unit for modulating a second modulation signal, input from the control unit, to a Pulse-Width Modulation (PWM) signal, the second modulation unit being disposed between the ultrasonic signal generation unit and the amplification unit.

Here, the second modulation signal may be configured such that at least one of the frequency and the amplitude thereof has a random value.

Here, the apparatus may further include a third modulation unit for generating airflow in order to modulate the recording prevention signal by generating a Doppler effect near the microphone of the electronic device.

Here, the control unit may control the third modulation unit so as to generate the airflow such that at least one of the direction, the speed, and the strength thereof is randomly set.

Here, the ultrasound output unit may further include a guard including multiple poles for making the distance between the transducer and the microphone of the electronic device equal to or greater than a threshold distance, slits may be formed between the multiple poles of the guard, and the poles and the slits may form at least one of a horizontal structure, a vertical structure, a cross structure, and a honeycomb structure.

Here, the guard may have a curved shape in order to prevent the microphone of the electronic device from coming into contact with the pole.

Here, the apparatus may further include a sensor unit for checking whether the electronic device is present using a sensor, and the control unit may perform control such that the recording prevention signal is radiated to the microphone of the electronic device only when it is determined that the electronic device is present.

Here, the sensor unit may check whether the electronic device is present using at least one of the transducer of the ultrasound output unit, a detector for detecting a leaking electromagnetic wave, a photodiode, and a pressure sensor.

Here, the ultrasound output unit may include multiple ultrasound output modules disposed along multiple surfaces, and each of the ultrasound output modules, including one or more transducers, may be operated by being associated with multiple channels.

Here, when the ultrasound output unit is configured with the multiple ultrasound output modules, the respective ultrasound output modules may have different frequencies, different phases, different duty cycles, and different amplitudes, or the respective ultrasound output modules may radiate the recording prevention signal, which is converted into the ultrasonic signal, in different directions.

Here, when the microphone is disposed at the backside of the electronic device, the control unit may vibrate an upper substrate on which the electronic device is disposed, thereby incapacitating the microphone.

Here, in the ultrasound output unit, a first transducer and a second transducer adjacent thereto may make a pair and operate, and the second transducer may be associated with a channel that differs from a channel with which the first transducer is associated.

Here, in order to minimize a shadow region, the control unit may change a relative phase between the first transducer and the second transducer or change the phase of the first transducer at preset intervals or at random intervals by setting a delay time.

Here, the apparatus may further include a protection circuit unit for voltage clamping in order to protect the transducer of the ultrasound output unit from overvoltage when a voltage equal to or greater than a threshold voltage is applied.

Also, an apparatus for preventing an electronic device from recording according to an embodiment of the present invention includes an ultrasonic circuit for generating a recording prevention signal in order to prevent an electronic device from recording; an ultrasound output unit for radiating the recording prevention signal in the form of an ultrasonic signal to the electronic device; and an air blower unit for generating airflow near the microphone of the electronic device in order to modulate the recording prevention signal. The ultrasound output unit may include a transducer for converting the recording prevention signal from an electrical signal into the ultrasonic signal; an output module for radiating the converted recording prevention signal to the microphone of the electronic device; and a guard configured with multiple poles and multiple slits and disposed between the transducer and the electronic device.

Also, a method for preventing an electronic device from recording, performed by an apparatus for preventing an electronic device from recording, according to an embodiment of the present invention includes generating a noise signal source; performing frequency modulation by controlling the value of at least one of a variable resistor and a variable capacitor based on information about the amplitude of the noise signal source; performing amplitude modulation by controlling the resistance value of a resonance unit based on information about the frequency of the noise signal source; converting the result of the frequency modulation and the amplitude modulation into a recording prevention signal in the form of an ultrasonic signal using a transducer; and radiating the converted recording prevention signal to the microphone of an electronic device.

BRIEF DESCRIPTION OF THE DRAWINGS

The above and other objects, features and advantages of the present invention will be more clearly understood from the following detailed description taken in conjunction with the accompanying drawings, in which:

FIG. 13 is an exemplary view that shows a guard in a curved shape and an apparatus for preventing an electronic device from recording that is disposed so as to be tilted according to an embodiment of the present invention;

DESCRIPTION OF THE PREFERRED EMBODIMENTS

Figure 1:
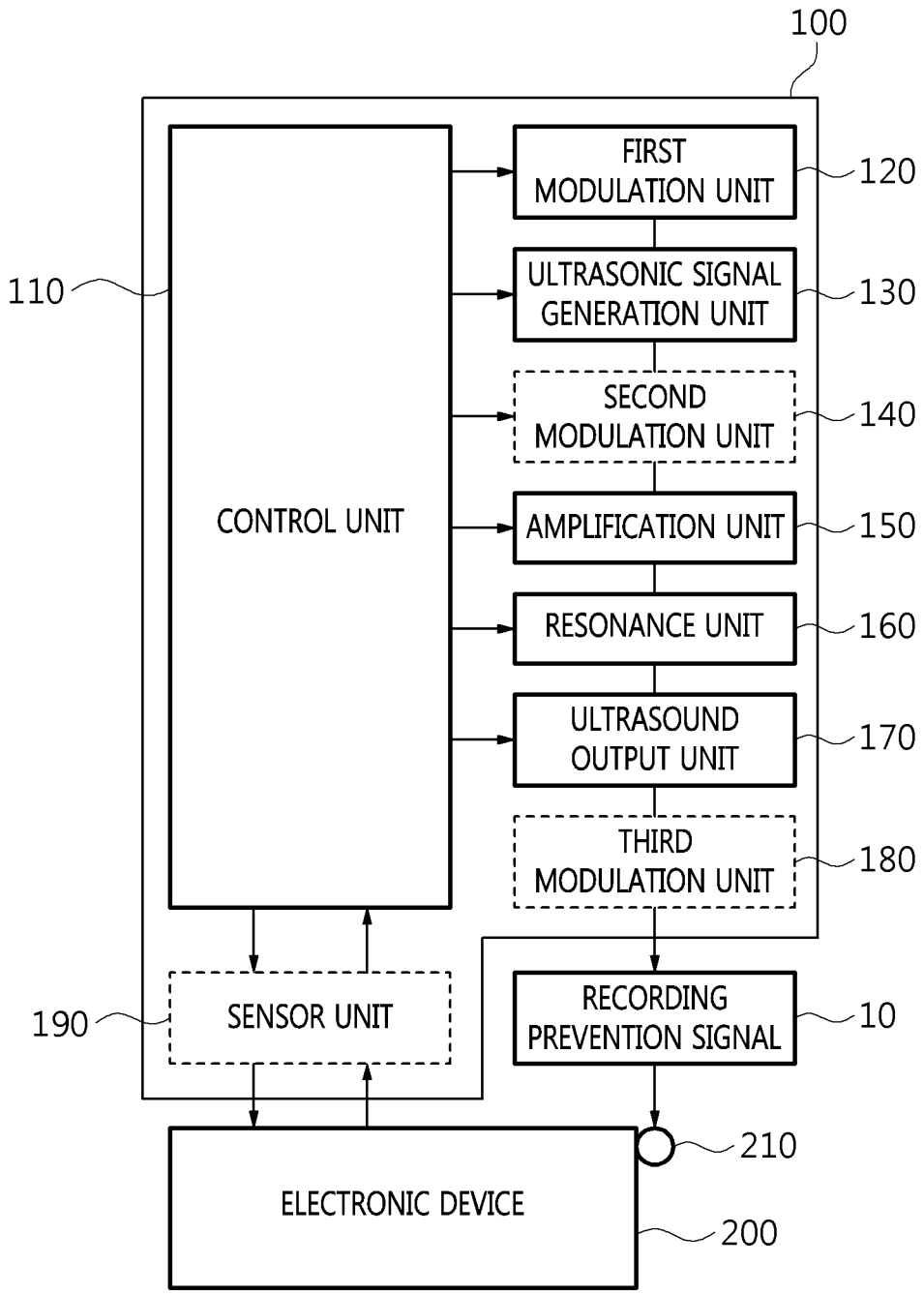
FIG. 1 is a block diagram that shows the configuration of an apparatus for preventing an electronic device from recording according to an embodiment of the present invention.

Because the present invention may be variously changed and may have various embodiments, specific embodiments will be described in detail below with reference to the attached drawings.

However, it should be understood that those embodiments are not intended to limit the present invention to specific disclosure forms and that they include all changes, equivalents or modifications included in the spirit and scope of the present invention.

The terms used in the present specification are merely used to describe specific embodiments, and are not intended to limit the present invention. A singular expression includes a plural expression unless a description to the contrary is specifically pointed out in context. In the present specification, it should be understood that terms such as "include" or "have" are merely intended to indicate that features, numbers, steps, operations, components, parts, or combinations thereof are present, and are not intended to exclude the possibility that one or more other features, numbers, steps, operations, components, parts, or combinations thereof will be present or added.

Unless differently defined, all terms used here including technical or scientific terms have the same meanings as terms generally understood by those skilled in the art to which the present invention pertains. Terms identical to those defined in generally used dictionaries should be interpreted as having meanings identical to contextual meanings of the related art, and are not to be interpreted as having ideal or excessively formal meanings unless they are definitively defined in the present specification.

Hereinafter, a preferred embodiment of the present invention will be described in detail with reference to the accompanying drawings. In the following description of the present invention, the same reference numerals are used to designate the same or similar elements throughout the drawings, and repeated descriptions of the same components will be omitted.

FIG. 1 is a block diagram that shows the configuration of an apparatus for preventing an electronic device from recording according to an embodiment of the present invention.

As illustrated in FIG. 1, the apparatus 100 for preventing an electronic device from recording radiates a recording prevention signal 10 to the microphone 210 of an electronic device 200, thereby preventing the electronic device 200 from recording.

The apparatus 100 for preventing an electronic device from recording includes a control unit 110, a first modulation unit 120, an ultrasonic signal generation unit 130, an amplification unit 150, a resonance unit 160, and an ultrasound output unit 170. Also, according to need, the apparatus 100 for preventing an electronic device from recording may be implemented so as to further include at least one of a second modulation unit 140, a third modulation unit 180, and a sensor unit 190.

In the apparatus 100 for preventing an electronic device from recording, an ultrasonic circuit, which includes the control unit 110, the first modulation unit 120, the ultrasonic signal generation unit 130, the amplification unit 150, and the resonance unit 160, is disposed under the upper substrate of the apparatus 100, whereby the recording prevention signal 10 may be radiated to the microphone 210 of the electronic device 200 disposed above the upper substrate.

Also, the apparatus 100 for preventing an electronic device from recording may operate in the state in which the apparatus 100 is installed so as to tilt at a certain angle in order to improve user convenience. Here, the apparatus 100 for preventing an electronic device from recording may be tilted at a fixed angle or a variable angle for user convenience.

For example, when the apparatus 100 for preventing an electronic device from recording is implemented so as to be installed in the terminal of a user or when the apparatus 100 for preventing an electronic device from recording is capable of running another application, the user may need to watch a screen displayed on the apparatus 100 or to manipulate the apparatus 100 in the state in which the apparatus 100 is fixed.

In this case, in the interest of visibility or convenience when the user manipulates the apparatus 100, the apparatus 100 for preventing an electronic device from recording according to an embodiment of the present invention may operate in the state in which the apparatus 100 is fixed so as to be tilted at a certain angle.

The control unit 110 may be configured with any one of a microprocessor, a Field-Programmable Gate Array (FPGA), and a Digital Signal Processor (DSP), which may control the components of the apparatus 100 for preventing an electronic device from recording. Also, the control unit 110 may generate a first modulation signal and a second modulation signal, which are noise signal sources.

Also, when the microphone 210 of the electronic device 200 is disposed at the backside thereof, the control unit 110 may vibrate the upper substrate on which the electronic device 200 is disposed in order to effectively incapacitate the recording function of the microphone 210.

The first modulation unit 120 may adjust the value of at least one of a variable resistor and a variable capacitor in the ultrasonic signal generation unit 130, thereby modulating the first modulation signal to a frequency-modulated (FM) signal. Also, the first modulation unit 120 may generate an amplitude-modulated (AM) signal based on information about the frequency of the first modulation signal, and may generate an FM signal based on information about the amplitude of the first modulation signal.

The ultrasonic signal generation unit 130 may generate an ultrasonic signal, the frequency of which is adjusted in such a way that the value of at least one of the variable resistor and the variable capacitor is changed depending on the magnitude of the FM signal.

The amplification unit 150 may increase or decrease the magnitude of the generated ultrasonic signal. The resonance unit 160 has an inductive impedance characteristic due to the load of the amplification unit 150, and may increase the voltage that is applied to a transducer by decreasing output impedance by generating resonance with the ultrasound output unit 170. Here, the resonance unit 160 may be configured with at least one of an inductor and a transformer.

Particularly, the amplification unit 150 may generate differential signals using a pair of inverters or a phase modulation circuit, and may use a differential amplifier in order to amplify a signal to be output relative to the generated signal. Also, it is possible to decrease the magnitude of an output signal or to block the output signal by adjusting the amplifier gain of the amplification unit 150. Here, the amplifier gain may be adjusted by variably setting the voltage to be applied to the amplifier, and may be controlled by a user or the control unit 110.

The ultrasound output unit 170 has a capacitive impedance characteristic through which an electrical signal is converted into an ultrasonic signal. The ultrasound output unit 170, configured with a transducer, may convert an electrical signal to an ultrasonic signal using the transducer, and may radiate the recording prevention signal, which is converted into the ultrasonic signal, to the microphone 210 of the electronic device 200, thereby incapacitating the recording function of the electronic device 200.

Because the recording prevention signal radiated by the ultrasound output unit 170 is in the ultrasonic frequency band, it is inaudible to a user who is located a certain distance or further away from the apparatus 100 for preventing an electronic device from recording. However, a parametric array, produced due to the nonlinearity of a medium such as air, causes the recording prevention signal to be demodulated in the recording prevention region in which the electronic device 200 is located, whereby the microphone 210 of the electronic device 200 located in the recording prevention region is prevented from acquiring other audible sound.

Also, the ultrasound output unit 170 may be disposed such that the distance between the transducer thereof and the electronic device 200 is equal to or greater than a threshold distance.

When the distance between the electronic device 200 and the transducer is less than the threshold distance, a shadow region may be generated. When the microphone 210 of the electronic device 200 is placed in the shadow region, the recording prevention signal may not be effectively input to the microphone 210.

Accordingly, the apparatus 100 for preventing an electronic device from recording according to an embodiment of the present invention may further include a guard for maintaining the distance between the transducer of the ultrasound output unit 170 and the electronic device 200 equal to or greater than the threshold distance. Accordingly, the electronic device 200 is located outside the region, the boundaries of which are defined by the guard (that is, is located such that the distance between the electronic device 200 and the transducer is equal to or greater than the threshold distance), whereby the shadow region related to the recording prevention signal may be minimized.

The guard includes multiple poles, and slits may be formed between the poles. Here, the poles and the slits may form at least one of a vertical structure, a horizontal structure, a cross structure, and a honeycomb structure.

Also, the guard may be implemented in a curved shape in order to enable the radiated recording prevention signal to be effectively input to the electronic device 200. When the microphone 210 of the electronic device 200 is screened by the poles of the guard, it is difficult for the recording prevention signal to be input to the microphone 210 normally. Accordingly, the apparatus 100 for preventing an electronic device from recording according to an embodiment of the present invention disposes a guard in a curved shape, thereby preventing the problem in which the microphone 210 of the electronic device 200 is screened by the poles of the guard and enabling the recording prevention signal to be input to the microphone 210 normally.

Also, if a guard in a curved shape is used, the apparatus 100 for preventing an electronic device from recording may be placed at a fixed position when the apparatus is mounted so as to be tilted.

The ultrasound output unit 170 may be implemented such that a first transducer forms a pair with a second transducer, and the control unit 110 changes the phase of the first transducer at regular periods or at random periods, thereby minimizing a shadow region.

The ultrasound output unit 170 is configured with multiple ultrasound output modules, and may be implemented such that the multiple ultrasound output modules are disposed along multiple surfaces. Here, each of the ultrasound output modules, which includes one or more transducers, may operate by being associated with multiple channels.

When the ultrasound output unit 170 includes multiple ultrasound output modules, the frequency, the phase, the duty cycle, and the amplitude of any one ultrasound output module may differ from those of another ultrasound output module. Also, the respective ultrasound output modules may radiate the recording prevention signals, which are converted into ultrasonic signals, in different directions.

Also, in order to protect the transducer of the ultrasound output unit 170 from overvoltage or overcurrent, the apparatus 100 for preventing an electronic device from recording according to an embodiment of the present invention may further include a protection circuit unit for voltage clamping when a voltage greater than a threshold voltage, that is, a clamping voltage, is applied. The protection circuit unit is disposed in parallel with the transducer of the ultrasound output unit 170, and may adjust the magnitude of the output when a signal, the voltage of which is equal to or greater than the preset threshold voltage, is applied.

Also, the apparatus 100 for preventing an electronic device from recording according to an embodiment of the present invention may further include a second modulation unit 140 that is disposed between the ultrasonic signal generation unit 130 and the amplification unit 150. The second modulation unit 140 modulates the second modulation signal, input from the control unit 110, to a Pulse-Width Modulation (PWM) signal. Here, at least one of the frequency and the amplitude of the second modulation signal may have a random value.

Also, the apparatus 100 for preventing an electronic device from recording may further include a third modulation unit 180 that generates a Doppler effect near the microphone 210 of the electronic device 200. The third modulation unit 180 modulates the recording prevention signal using wind (airflow), whereby irregular and complex noise (a recording prevention signal) may be input to the microphone 210 of the electronic device 200.

Particularly, the air blower of the third modulation unit 180 may form airflow based on a random value, and the control unit 110 may control at least one of the direction, the speed, and the strength of airflow generated by the third modulation unit 180.

The sensor unit 190 checks whether an electronic device 200 in which the microphone 210 is embedded is present using a sensor. Here, the sensor unit 190 may check whether the electronic device 200 is present using at least one of the transducer of the ultrasound output unit, a detector for detecting a leaking electromagnetic wave, a photodiode, and a pressure sensor.

When the apparatus 100 for preventing an electronic device from recording continues to radiate a recording prevention signal in the form of ultrasound, the energy efficiency may be reduced, and the recording prevention signal may make a user feel tired. Accordingly, the apparatus 100 for preventing an electronic device from recording according to an embodiment of the present invention checks whether the electronic device 200, which is the target of recording prevention, is present in a recording prevention region using the sensor unit 190, and the control unit 110 may control the respective components of the apparatus 100 such that a recording prevention signal is radiated to the microphone 210 of the electronic device 200 only when the sensor unit 190 detects the presence of the electronic device 200.

Here, the sensor unit 190 may check whether the electronic device 200 is present by checking the operation of the microphone of the electronic device 200 using a leaking electromagnetic wave of the electronic device 200 or by checking a change in the weight of the upper substrate on which the electronic device 200 is placed using a pressure sensor. Also, the sensor unit 190 may check whether the electronic device 200 is present using a photodiode or the like, or may check whether the electronic device 200 is present with an ultrasonic signal using the transducer of the ultrasound output unit 170.

Hereinafter, a method for preventing an electronic device from recording, which is performed by an apparatus for preventing an electronic device from recording, according to an embodiment of the present invention will be described in more detail with reference to FIG. 2 and FIG. 3.

Figure 2:
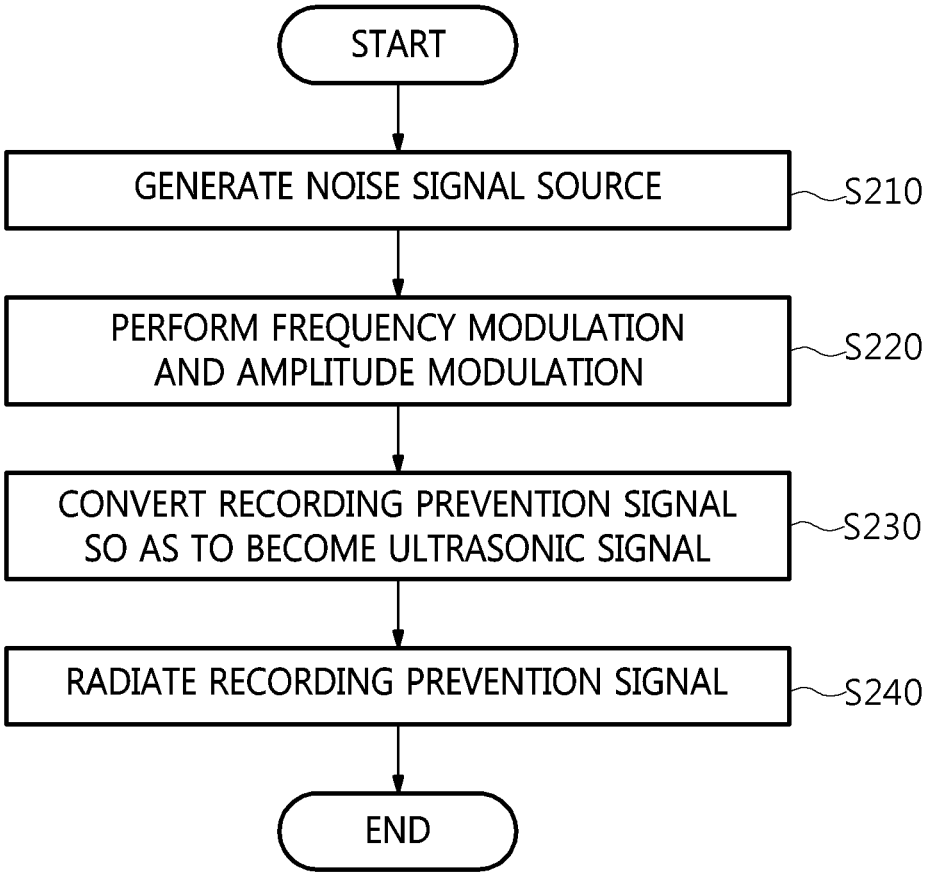
FIG. 2 is a flowchart for explaining a method for preventing an electronic device from recording according to an embodiment of the present invention.

FIG. 2 is a flowchart for explaining a method for preventing an electronic device from recording according to an embodiment of the present invention.

First, the apparatus 100 for preventing an electronic device from recording generates a noise signal source at step S210.

The apparatus 100 for preventing an electronic device from recording generates a first modulation signal and a second modulation signal, which are noise signal sources to be applied to a modulation unit. Here, at least one of the first modulation signal and the second modulation signal may have a random frequency and a random amplitude.

Figure 3:
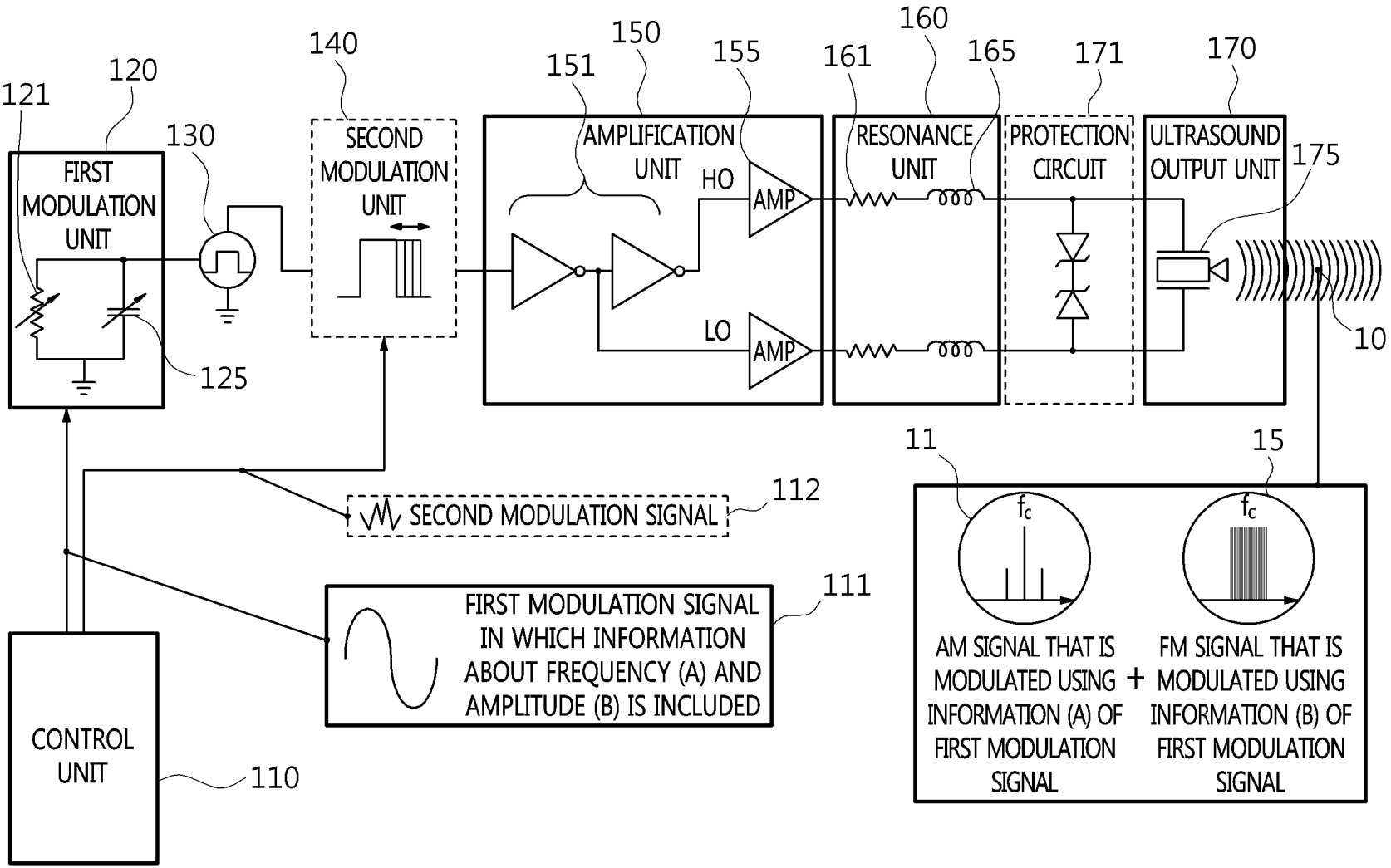
FIG. 3 is a view that shows a process in which an apparatus for preventing an electronic device from recording generates a recording prevention signal according to an embodiment of the present invention.

FIG. 3 is a view that shows a process in which a recording prevention signal is generated by the apparatus for preventing an electronic device from recording according to an embodiment of the present invention.

As illustrated in FIG. 3, the control unit 110 of the apparatus 100 for preventing an electronic device from recording may generate a first modulation signal 111 having frequency and amplitude information and deliver the same to the first modulation unit 120. Also, the control unit 110 of the apparatus 100 for preventing an electronic device from recording may generate a second modulation signal and deliver the same to the second modulation unit 140.

Also, the apparatus 100 for preventing an electronic device from recording performs frequency modulation and amplitude modulation at step S220.

The first modulation unit 120, having received the first modulation signal 111, may perform amplitude modulation based on the frequency information of the first modulation signal 111 and may perform frequency modulation based on the amplitude information of the first modulation signal 111. That is, the apparatus 100 for preventing an electronic device from recording may perform two types of modulation using a single signal source.

Here, the first modulation unit 120 may perform frequency modulation by adjusting the value of at least one of the variable resistor and the variable capacitor of the ultrasonic signal generation unit 130. The value of the variable resistor or the value of the variable capacitor of the ultrasonic signal generation unit 130 changes depending on the magnitude of the first modulation signal 111, and when the value of the first modulation signal 111 varies over time, an FM signal having bandwidth proportional to the variation may be generated.

The second modulation unit 140, having received the second modulation signal 112, may perform pulse-width modulation between the ultrasonic signal generation unit 130 and the amplification unit 150.

Also, the apparatus 100 for preventing an electronic device from recording may increase or decrease the magnitude of the ultrasonic signal generated by the ultrasonic signal generation unit 130 using the amplification unit 150. The amplification unit 150 may generate differential signals using a pair of inverters 151 or a phase modulation circuit, and may adjust the magnitude of the ultrasonic signal output through the differential amplifier 155.

Also, the apparatus 100 for preventing an electronic device from recording forms the output load of the amplification unit 150 as a serial resonance structure in which the inductor 165 of the resonance unit 160 is coupled to a capacitor configured with the transducer array of the ultrasound output unit 170. Accordingly, the impedance of the load is changed depending on the operating frequency, whereby the amplitude of a waveform may be changed.

When a signal, the frequency of which changes over time, is applied to the load of the resonance structure, the envelope of the output signal generates a new signal. As described above, amplitude modulation, in which the envelope is determined depending on the frequency of the applied signal, may be implemented.

Figure 4:
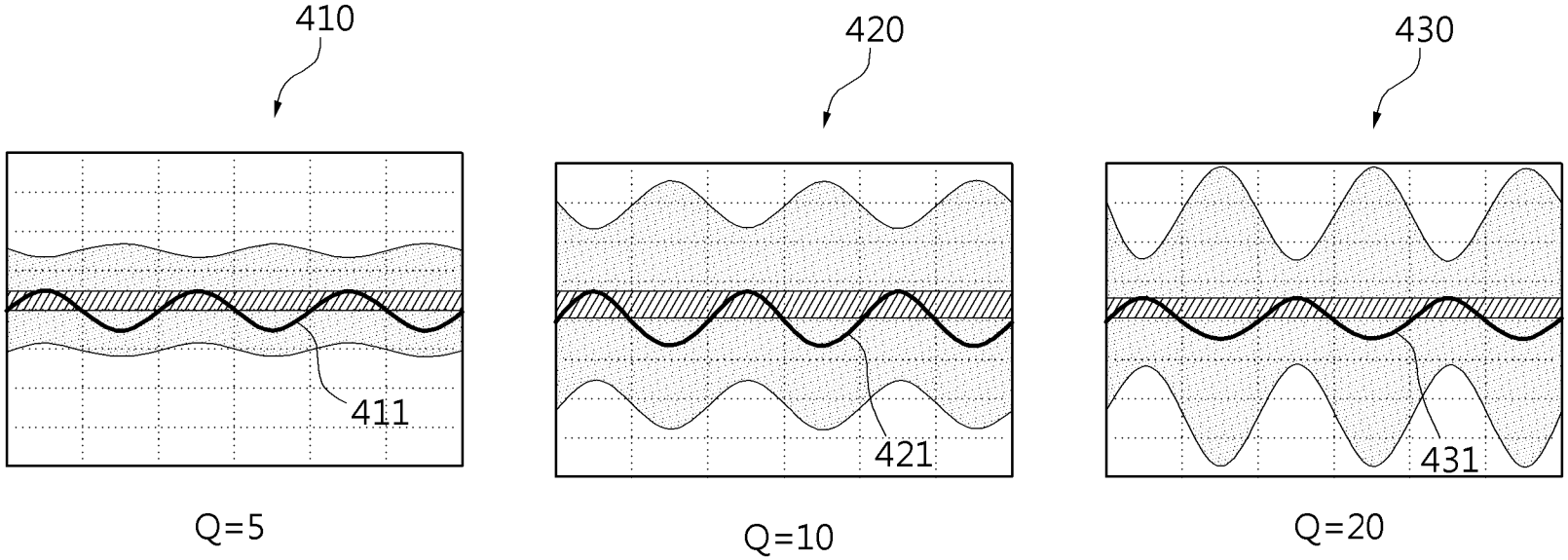
FIG. 4 is an exemplary view that shows a waveform output from an apparatus for preventing an electronic device from recording depending on a Quality (Q) factor of a load according to an embodiment of the present invention.

FIG. 4 is an exemplary view that shows the output waveform of an apparatus for preventing an electronic device from recording depending on the Q factor of the load according to an embodiment of the present invention.

As illustrated in FIG. 4, the magnitude of an amplitude-modulated output signal may be adjusted by adjusting the Quality (Q) factor of the load by adjusting the resistor 161 of the load of the resonance unit 160. The first modulation signal 411, 421 or 431 and the waveform depending on the Q factor of the load are illustrated in FIG. 4.

In FIG. 4, the first output waveform 410 is the output waveform when the Q factor of the load is 5, the second output waveform 420 is the output waveform when the Q factor of the load is 10, and the third output waveform 430 is the output waveform when the Q factor of the load is 20.

Also, the DC offset of the first modulation signal 411 may determine the center frequency $f_C$ of an ultrasonic wave for which frequency modulation is to be performed, the frequency of the first modulation signal 421 may determine an amplitude modulation frequency, and the amplitude of the first modulation signal 431 may determine the bandwidth of the frequency of frequency modulation. Here, the frequency and the amplitude of the first modulation signal 421 may be randomly changed over time.

Figure 5:
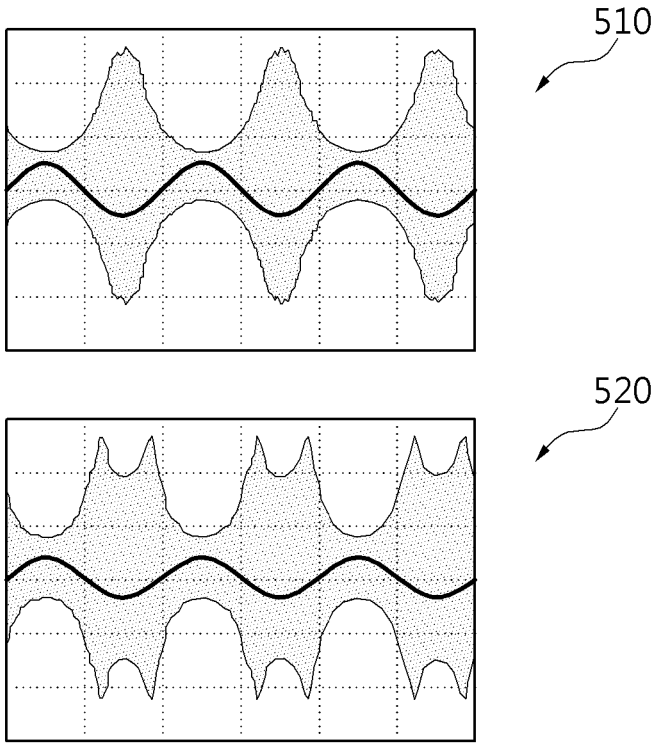
FIG. 5 is an exemplary view that shows a waveform output from an apparatus for preventing an electronic device from recording depending on the relationship between a center frequency, a resonant frequency, and FM bandwidth according to an embodiment of the present invention.

Also, the shape of an envelope may be changed depending on the bandwidth $f_{BW}$, the center frequency $f_C$ of a frequency oscillator, and the resonant frequency $f_R$ of the load, as shown in FIG. 5.

FIG. 5 is an exemplary view that shows the output waveform of an apparatus for preventing an electronic device from recording depending on the relationship between a center frequency, a resonant frequency, and FM bandwidth according to an embodiment of the present invention.

The third output waveform 510 in FIG. 5 is the waveform when $fBW/2 \leq |f_C - f_R|$ is satisfied, and the fourth output waveform 520 is the waveform when $fBW/2 > |f_C - f_R|$ is satisfied.

Like the third output waveform 510, when the difference between the center frequency $f_C$ and the resonant frequency $f_R$ is greater than the FM bandwidth, the envelope of the output waveform becomes the same as the frequency of the first modulation signal 511. Conversely, when the difference between the center frequency $f_C$ and the resonant frequency $f_R$ is less than the FM bandwidth, the envelope of the output waveform includes the secondary harmonic component of the first modulation signal 521

Accordingly, the apparatus 100 for preventing an electronic device from recording according to an embodiment of the present invention may generate a more complex AM signal. The apparatus 100 for preventing an electronic device from recording may generate a modulation signal by setting the difference between the resonant frequency $f_R$ of the resonance unit and the center frequency $f_C$ of the frequency oscillator to be less than the FM bandwidth $f_{BW}$.

Particularly, the apparatus 100 for preventing an electronic device from recording according to an embodiment of the present invention performs amplitude modulation and frequency modulation using a single modulation signal based on the simple circuit structure shown in FIG. 3, thereby generating a recording prevention signal that is modulated in a complicated manner. That is, in spite of a simple circuit structure, a complex recording prevention signal may be generated.

Reference is again to be made to FIG. 3. The apparatus 100 for preventing an electronic device from recording converts the recording prevention signal from an electrical signal into an ultrasonic signal at step S230 and radiates the recording prevention signal at step S240.

The apparatus 100 for preventing an electronic device from recording converts the electrical signal into an ultrasonic signal using a transducer and radiates the recording prevention signal in the form of an ultrasonic signal to the microphone of the electronic device.

Here, in order to effectively radiate the recording prevention signal to the microphone of the electronic device and to minimize a shadow region, the apparatus 100 for preventing an electronic device from recording according to an embodiment of the present invention may use a guard configured with multiple poles or a guard in a curved shape, and may vibrate the upper substrate on which the electronic device is placed.

Also, the apparatus 100 for preventing an electronic device from recording generates airflow using an air blower unit, thereby enabling the recording prevention signal modulated by airflow to be input to the electronic device. Here, because the air blower unit is the same as the third modulation unit 180 in FIG. 1, a repeated description thereof will be omitted.

Hereinafter, the configuration of a third modulation unit according to an embodiment of the present invention will be described in detail with reference to FIG. 6.

Figure 6:
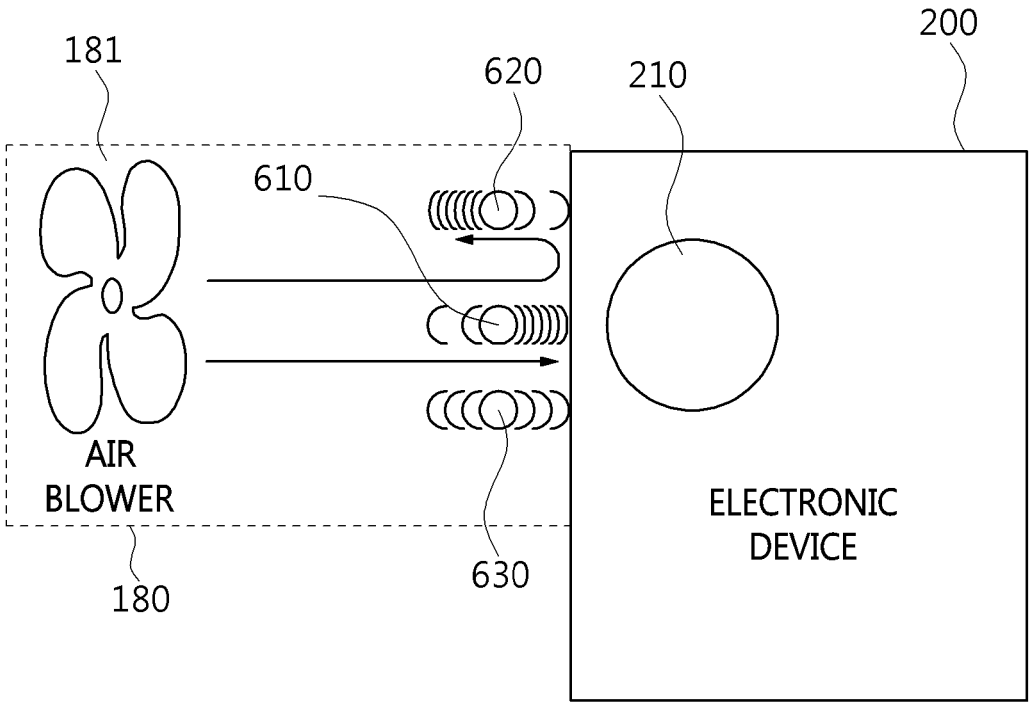
FIG. 6 is a view for explaining the modulation principle of a third modulation unit according to an embodiment of the present invention.

FIG. 6 is a view for explaining the modulation principle of a third modulation unit according to an embodiment of the present invention.

The apparatus 100 for preventing an electronic device from recording according to an embodiment of the present invention may modulate a recoding prevention signal by artificially generating the Doppler effect by moving air, which is the medium for delivering the recording prevention signal in the form of an ultrasonic wave.

As shown in FIG. 6, when air, which is the medium for delivering the recording prevention signal, is forced to move, the direction in which air moves may be the same as the direction in which the recording prevention signal moves. Also, airflow generated by the air blower 181 crashes against the electronic device 200, whereby airflow in the direction that is opposite the direction in which airflow generated by the air blower 181 moves may be generated.

In FIG. 6, first particles 610 represent particles when the direction in which air moves is the same as the direction in which the recording prevention signal is delivered, in which case the frequency of the first particles 610 becomes greater than the original frequency. Conversely, second particles 620 represent particles moved by reverse airflow generated in such a way that the airflow generated by the air blower 181 crashes against the electronic device 200. The frequency of the second particles 620 becomes lower than the original frequency.

Because not all of the air particles are affected by the air blower 181, there may be third particles 630 that are not affected by the airflow generated by the air blower 181, as shown in FIG. 6, and the first particles 610, the second particles 620, and the third particles 630 may exist together.

Also, a parametric array, based on nonlinearity of air, causes generation of a secondary signal, the frequency of which is equal to the difference between the frequencies of ultrasonic waves. Here, when the frequency of the generated secondary signal falls within in an audible frequency range, the secondary signal in the audible range may be recorded through the microphone 210 of the electronic device 200. Here, the frequency of the secondary signal may be controlled using the speed of air particles, the speed of ultrasonic waves, and the frequency, and the frequency of the secondary signal may be represented as shown in the following Equation (1):

$$\Delta f = \left(\frac{v_{fbw}}{v_{sound} - v_{fbw}}\right) f \tag{1}$$

where $\Delta f$ denotes the frequency of the secondary signal, which is the difference between the frequencies of ultrasonic waves, $v_{sound}$ denotes the speed of an ultrasonic wave, $v_{fbw}$ denotes the speed of airflow generated by the air blower 181, and f denotes the frequency of an ultrasonic transducer.

Figure 7:
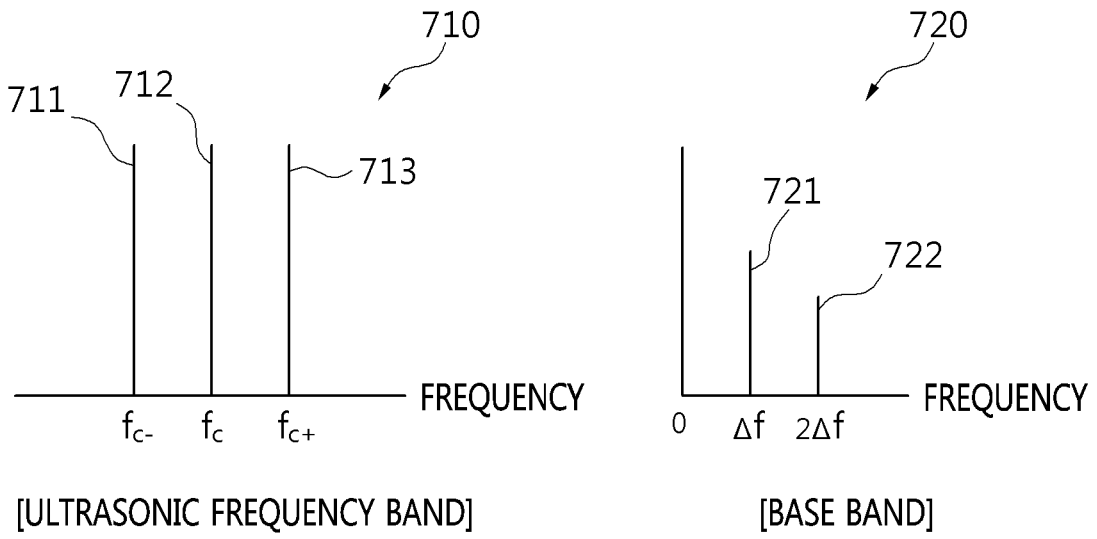
FIG. 7 is an exemplary view that shows a frequency spectrum attributable to the Doppler effect according to an embodiment of the present invention.

The frequency modulation by the frequency difference $\Delta f$ is caused, whereby the spectra shown in FIG. 7 appear in the ultrasonic frequency band and the base band.

Figure 8:
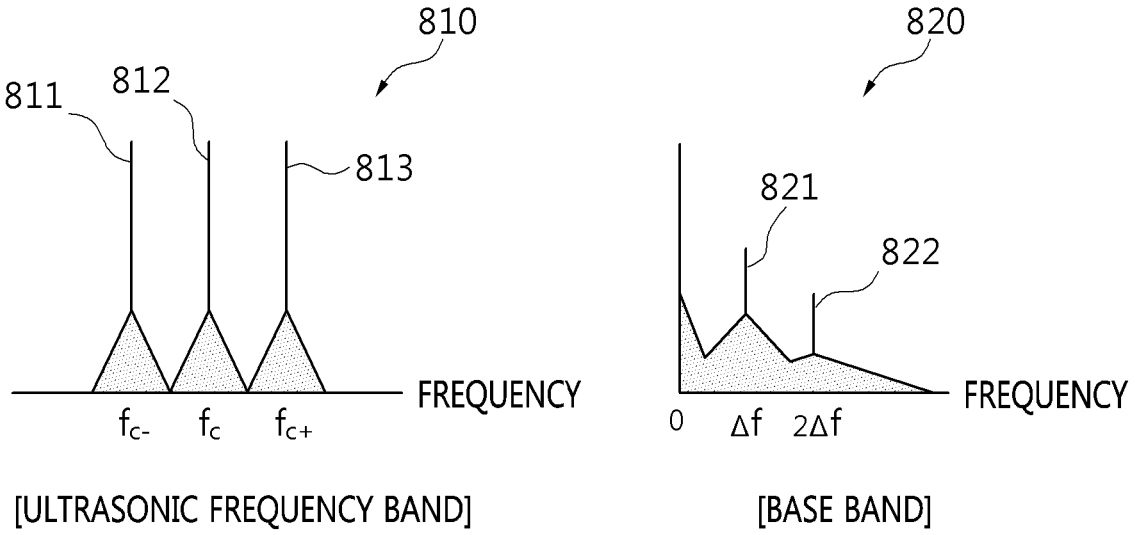
FIG. 8 is an exemplary view that shows a frequency spectrum attributable to the Doppler effect when an ultrasonic signal modulated to an audible signal is applied according to an embodiment of the present invention.

FIG. 7 is an exemplary view that shows the frequency spectrum attributable to the Doppler effect according to an embodiment of the present invention, and FIG. 8 is an exemplary view that shows the frequency spectrum attributable to the Doppler effect when an ultrasonic signal modulated to an audible signal is applied according to an embodiment of the present invention.

The frequency spectra 710 and 810 by the Doppler effect in the ultrasonic frequency band respectively show the frequency spectra 711 and 811 that appear when the direction of airflow differs from the direction of an ultrasonic wave, the frequency spectra 712 and 812 that appear when the direction of an ultrasonic wave is not affected by airflow, and the frequency spectra 713 and 813 that appear when the direction of airflow is the same as the direction of an ultrasonic wave. Also, the frequency spectra 720 and 820 by the Doppler effect in the base band show the spectra 721 and 821 that appear when the frequency is equal to $f_{c+}-f_c$ or $f_c-f_{c-}$ and the spectra 722 and 822 that appear when the frequency is equal to $f_{c+}-f_{c-}$.

When the recording prevention signal, which is an ultrasonic signal modulated to a noise signal in an audible range by applying various modulation methods to the ultrasonic signal, is radiated, a secondary signal generated due to the nonlinearity of air may form a baseband noise spectrum that is wider than the original one.

When the airflow generated by the air blower 181 is directed only to the electronic device 200, because a nonlinearity effect is caused only in the vicinity of the electronic device 200 in which airflow drastically changes, noise is generated only in a narrow area. Accordingly, the noise signal is hardly audible to a user, but the recording function of the electronic device 200 may be incapacitated. Also, when modulation is performed using airflow, the frequency of a noise signal may be modulated without degrading the performance of a transducer.

Figure 9:
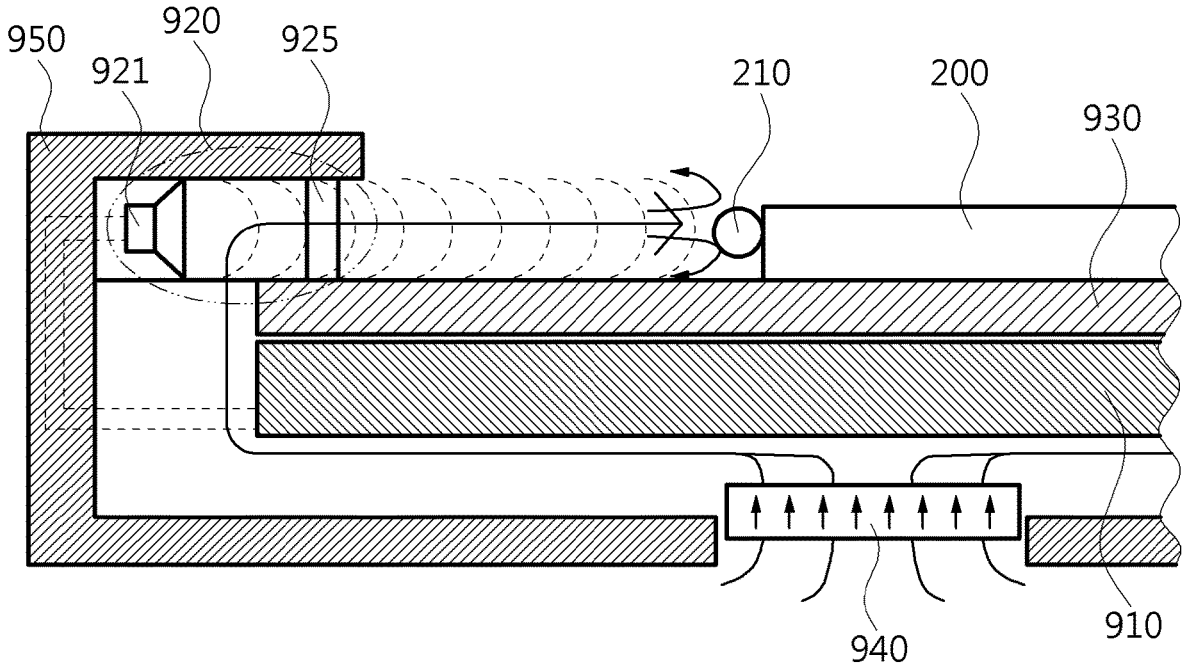
FIG. 9 is a view that shows the configuration of an apparatus for preventing an electronic device from recording that includes a third modulation unit according to an embodiment of the present invention.

The third modulation unit 180 of the apparatus 100 for preventing an electronic device from recording, in which the above-described characteristics are used, is as shown in FIG. 9.

FIG. 9 is a view that shows the configuration of an apparatus for preventing an electronic device from recording that includes the third modulation unit according to an embodiment of the present invention.

As shown in FIG. 9, an ultrasonic circuit 910 for generating a recording prevention signal is disposed under the upper substrate 930, and an ultrasound output unit 920 for radiating the recording prevention signal in the form of an ultrasonic signal may be disposed above the upper substrate 930.

Here, because the ultrasonic circuit 910 is the same as the ultrasonic circuit including the control unit 110, the first modulation unit 120, the ultrasonic signal generation unit 130, the amplification unit 150, and the resonance unit 160 in FIG. 1, a repeated description thereof will be omitted.

Particularly, the control unit of the ultrasonic circuit 910 may send a control signal to an air blower unit 940, and may control at least one of the direction, the speed, and the strength of airflow. Particularly the control unit of the ultrasonic circuit 910 may randomly control at least one of the direction, the speed, and the strength of airflow.

The ultrasound output unit 920 radiates a recording prevention signal to the microphone 210 of the electronic device 200 that is placed on the upper substrate 930, thereby preventing the electronic device 200 from recording.

The transducer 921 of the ultrasound output unit 920 converts the recording prevention signal from an electrical signal into an ultrasonic signal and radiates the recording prevention signal in the form of an ultrasonic signal through the ultrasound output module.

Also, the ultrasound output unit 920 may include a guard through which the physical distance between the transducer 921 and the electronic device 200 may be maintained longer than a certain distance Δd. The guard 925 includes multiple poles and multiple slits are formed by the multiple poles. Here, the poles and the slits of the guard 925 may form at least one of a vertical structure, a horizontal structure, a cross structure, and a honeycomb structure.

Also, the guard 925 is disposed between the transducer 921 and the electronic device 200, and may be implemented so as to have a curved shape. Accordingly, the problem in which the recording prevention signal is not input to the microphone 210 of the electronic device 200 normally because the small microphone 210 is screened by the pole of the guard 925 may be prevented. Also, when the guard 925 is implemented so as to have a curved shape, the electronic device 200 may be placed at a fixed position in the state in which the upper substrate, on which the electronic device 200 is disposed, is tilted.

Also, an air blower unit 940 may be disposed in the lower part of a case 950. The air blower unit 940 may generate airflow in the vicinity of the microphone 210 of the electronic device 200 in order to modulate the recording prevention signal using airflow.

The position of the air blower unit 940 is not limited to the lower part of the case 950. The air blower unit 940 may be variously designed to be located at any position that enables airflow to be generated in the vicinity of the microphone 210 of the electronic device 200.

The air blower unit 940 may generate airflow that is sucked into or expelled from the ultrasound output unit 920 by sucking in or expelling air through the air escape formed in the case 950. Here, the case 950 may be formed so as to have no gap, excluding the air escape and the ultrasound output unit.

The airflow generated by the air blower unit 940 may cool the heat generated in the ultrasonic circuit 910, and may generate the Doppler effect in the vicinity of the microphone 210 of the electronic device 200, thereby applying third modulation to the radiated recording prevention signal.

The apparatus for preventing an electronic device from recording shown in FIG. 9 is merely an embodiment, and the apparatus for preventing an electronic device from recording may be designed such that the respective components thereof may be disposed in different positions according to need.

Hereinafter, the guard of an ultrasound output unit according to an embodiment of the present invention will be described in detail with reference to FIGS. 10 to 13.

Figure 10:
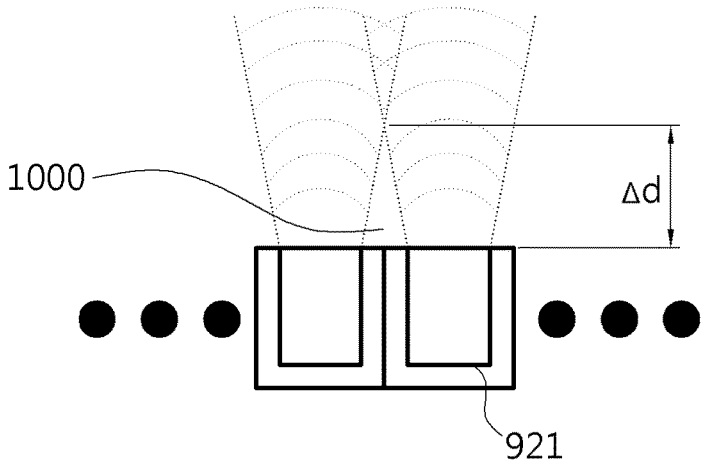
FIG. 10 is a view that shows a shadow region according to an embodiment of the present invention.

FIG. 10 is a view that shows a shadow region according to an embodiment of the present invention.

Between transducers 921, there is a shadow region 1000 in which there is no effect of ultrasonic signals. When the microphone 210 of an electronic device 200 is located in the shadow region 1000, the recording prevention signal radiated by the apparatus 100 for preventing an electronic device from recording is not able to incapacitate the recording function of the electronic device 200.

Accordingly, the apparatus 100 for preventing an electronic device from recording according to an embodiment of the present invention disposes a guard in order to prevent the microphone 210 of the electronic device 200 from being placed in the shadow region 1000, in which there is no effect of ultrasonic signals, whereby the shadow region may be avoided.

Figure 11:
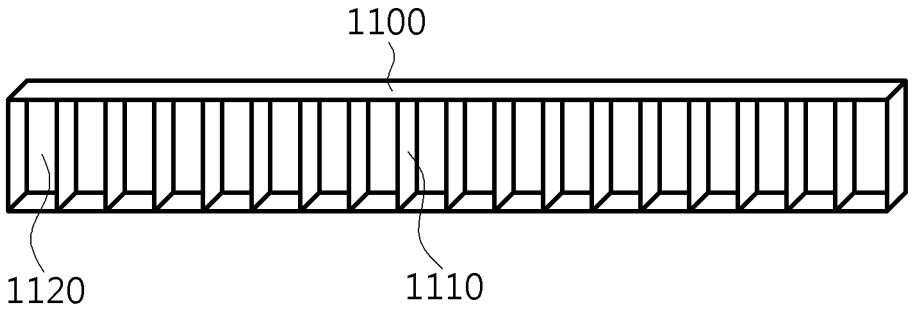
FIG. 11 is an exemplary view that shows a guard according to an embodiment of the present invention.

Particularly, the shadow region 1000 is generated at the location at which the distance from the transducer 921 is equal to or less than a threshold distance Δd, and the apparatus 100 for preventing an electronic device from recording according to an embodiment of the present invention may be implemented such that a guard is disposed in order to make the distance between the transducer 921 and the microphone 210 of the electronic device 200 equal to or greater than the threshold distance, as shown in FIG. 11, which will be described below.

FIG. 11 is an exemplary view that shows a guard according to an embodiment of the present invention.

As shown in FIG. 11, the guard 1100 includes multiple poles 1110, and multiple slots 1120 are formed by the multiple poles 1110. The guard 1100 is disposed in order to make the distance between the transducer of the apparatus 100 for preventing an electronic device from recording and an electronic device 200 equal to or greater than a threshold distance, whereby a recording prevention signal radiated from the transducer may be delivered to the electronic device 200 without gaps.

When the guard 1100 is disposed as shown in FIG. 11, the apparatus 100 for preventing an electronic device from recording may be placed on the front side (or backside) of the guard 1100, and the electronic device 200 may be placed on the back side (or front side) of the guard 1100. Here, the guard 1100 may be disposed such that the distance between the apparatus 100 for preventing an electronic device from recording and the electronic device 200 is greater than the threshold distance Δd in FIG. 10.

The poles 1110 and the slots 1120 of the guard 1100 may be vertically arranged by standing the poles 110 upright, as shown in FIG. 11, and may be designed and implemented in a different form, such as a horizontal structure, a cross structure, a honeycomb structure, or the like, according to need.

Figure 12:
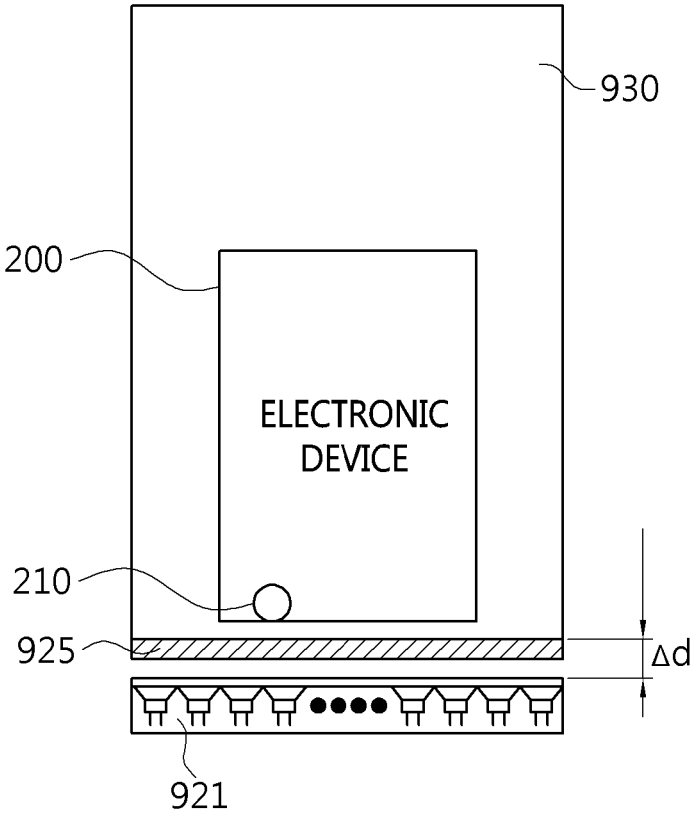
FIG. 12 is an exemplary view for explaining the disposition of a guard according to an embodiment of the present invention.

FIG. 12 is an exemplary view for explaining the disposition of a guard according to an embodiment of the present invention.

As shown in FIG. 12, the guard 925 may be disposed a certain distance Δd apart from the transducer 921 in consideration of the radiation angle of the transducer 921. The guard 925 may be designed such that ultrasound and airflow are capable of passing through the slots in the guard 925 and such that the electronic device 200 is not capable of passing through the slots.

FIG. 13 is an exemplary view that shows a guard in a curved shape and an apparatus for preventing an electronic device from recording that is tilted according to an embodiment of the present invention.

When the tiny microphone 210 of an electronic device 200 is in contact with a pole of a guard 925, a recording prevention signal may be incapacitated. In this case, because the radiated recording prevention signal is not properly input to the microphone 210 of the electronic device 200, the recording prevention effect is reduced.

In order to solve the above problem, the apparatus 100 for preventing an electronic device from recording according to an embodiment of the present invention may apply a guard in a curved shape 927, as shown in FIG. 13. Also, the apparatus 100 for preventing an electronic device from recording may be installed such that the apparatus 100 is tilted at a certain angle using the guard.

As shown in FIG. 13, a groove 1310 is formed in the back side of the apparatus 100 for preventing an electronic device from recording, and a support pole 1320 is fixed to the groom 1310, whereby the apparatus 100 for preventing an electronic device from recording may operate in the state in which the apparatus 100 is tilted.

Figure 14:
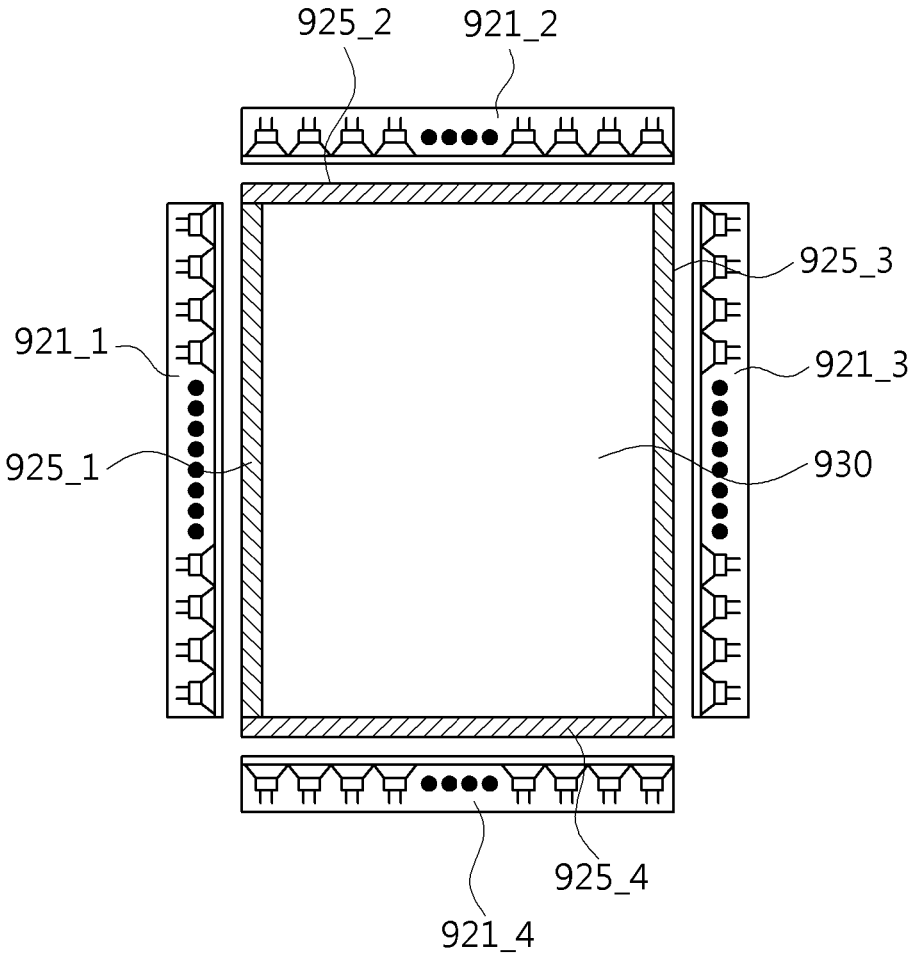
FIG. 14 is an exemplary view that shows the disposition of multiple ultrasound output modules according to an embodiment of the present invention.

FIG. 14 is an exemplary view that shows the disposition of multiple ultrasound output modules according to an embodiment of the present invention.

In order to prepare for the case in which an electronic device 200 includes multiple microphones 210 or in which two or more microphones 210 are oriented in different directions, the apparatus 100 for preventing an electronic device from recording according to an embodiment of the present invention may include multiple ultrasound output modules 921 in the ultrasound output unit, and may arrange the ultrasound output modules 921 along the multiple surfaces of the upper substrate 930.

Here, the respective ultrasound output modules 921 operate depending on signals individually applied thereto, and may be designed so as to operate by being associated with multiple channels. When the respective ultrasound output modules 921 operate by being associated with multiple channels, the respective ultrasound output modules 921 may radiate recording prevention signals in different directions.

Also, when multiple channels are associated, the respective ultrasound output modules may include their own ultrasonic circuits, and the respective channels may have different characteristic information including at least one of a frequency, a phase, a duty cycle, and an amplitude.

In order to prepare for the case in which the microphone 210 of the electronic device 200 is located at the backside thereof, the apparatus 100 for preventing an electronic device from recording may vibrate the upper substrate 930 thereof, thereby incapacitating the microphone 210 of the electronic device 200.

Here, the apparatus 100 for preventing an electronic device from recording may generate vibration by operating at least one of a motor and a piezoelectric element under the control of the control unit, and the control unit may generate vibration only when the sensor unit detects that the microphone 210 of the electronic device 200 is located at the backside thereof, that is, that the microphone 210 is located close to the upper substrate 930.

Hereinafter, an apparatus for preventing an electronic device from recording that includes a transducer pair structure according to an embodiment of the present invention will be described in detail with reference to FIG. 15 and FIG. 16.

Figure 15:
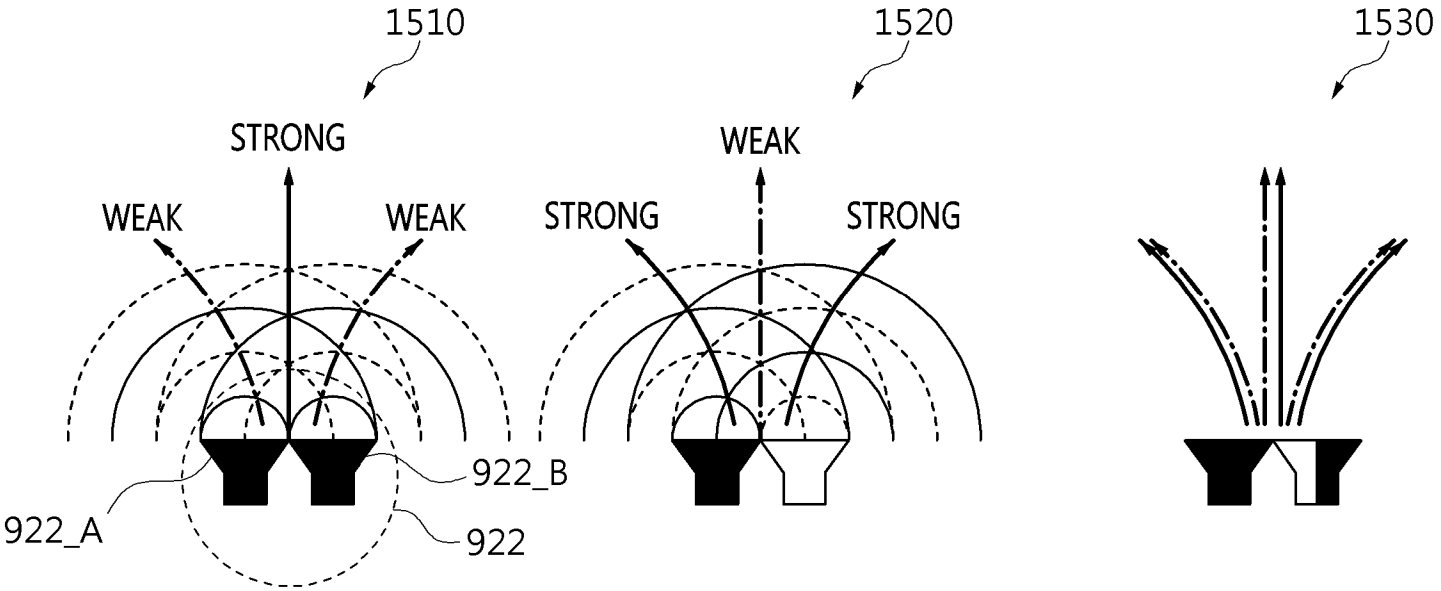
FIG. 15 is a view for explaining a shadow region generated depending on the characteristics of a wave according to an embodiment of the present invention.
Figure 16:
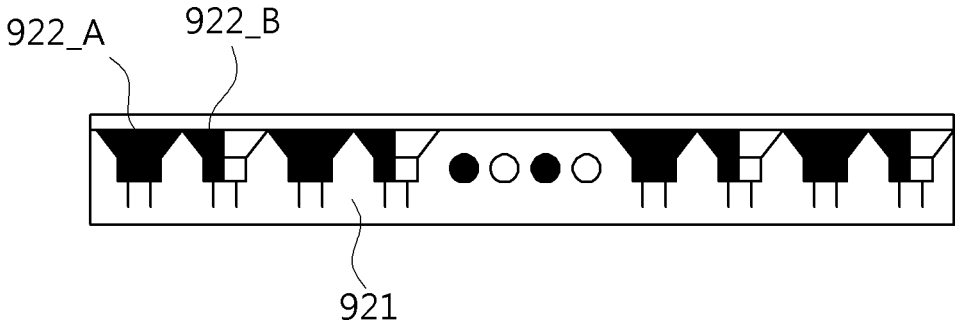
FIG. 16 is an exemplary view that shows an ultrasound output unit that includes a pair of transducers according to an embodiment of the present invention.

FIG. 15 is a view for explaining a shadow region depending on the characteristics of a wave according to an embodiment of the present invention, and FIG. 16 is an exemplary view that shows an ultrasound output unit that includes a pair of transducers according to an embodiment of the present invention.

As shown in FIG. 15, a shadow region may also be caused due to wave characteristics.

When a transducer 922_*a* and an additional transducer 922_*b* adjacent thereto have the same phase (1510) or when the phase of the transducer 922_*a* is opposite the phase of the additional transducer 922_*b* (1520), constructive interference or destructive interference occurs. Here, a shadow region is generated in the region in which destructive interference has occurred.

That is, when the transducer 922_*a* and the additional transducer 922_*b* adjacent thereto have the same phase or opposite phases, a shadow region is generated. In order to solve the problem of a shadow region, the apparatus 100 for preventing an electronic device from recording according to an embodiment of the present invention may continuously control the transducers in order to generate a relative phase difference.

Particularly, the apparatus 100 for preventing an electronic device from recording according to an embodiment of the present invention may form a transducer pair 1530 comprising the transducer 922_*a* and the additional transducer 922_*b* adjacent thereto, and may minimize the shadow region by changing the phase of the additional transducer 922_*b* over time.

As shown in FIG. 16, the transducer 922_*a* and the additional transducer 922_*b* adjacent thereto are formed as a transducer pair configured with two channels, each of which receives its own input. That is, the transducer 922_*a* and the additional transducer 922_*b* adjacent thereto operate as a pair, and the transducer 922_*a* has a channel that differs from the channel of the additional transducer 922_*b* adjacent thereto.

Also, the location at which constructive interference or destructive interference occurs is changed by changing the phase of the additional transducer 922_*b* periodically (at regular intervals or at random intervals), whereby the problem of a shadow region may be solved. Alternatively, the effect of changing the phase may be acquired using a time delay.

The transducer pair may be controlled by the control unit, and the control unit may control at least one of the phase, the delay time, and the frequency, thereby making a relative phase difference between the transducer 922_*a* and the additional transducer 922_*b* adjacent thereto change over time. Also, the control unit changes the delay time at preset intervals or at random intervals and delays the phase by the delay time, thereby generating a relative phase difference between the transducer 922_*a* and the additional transducer 922_*b* adjacent thereto.

Figure 17:
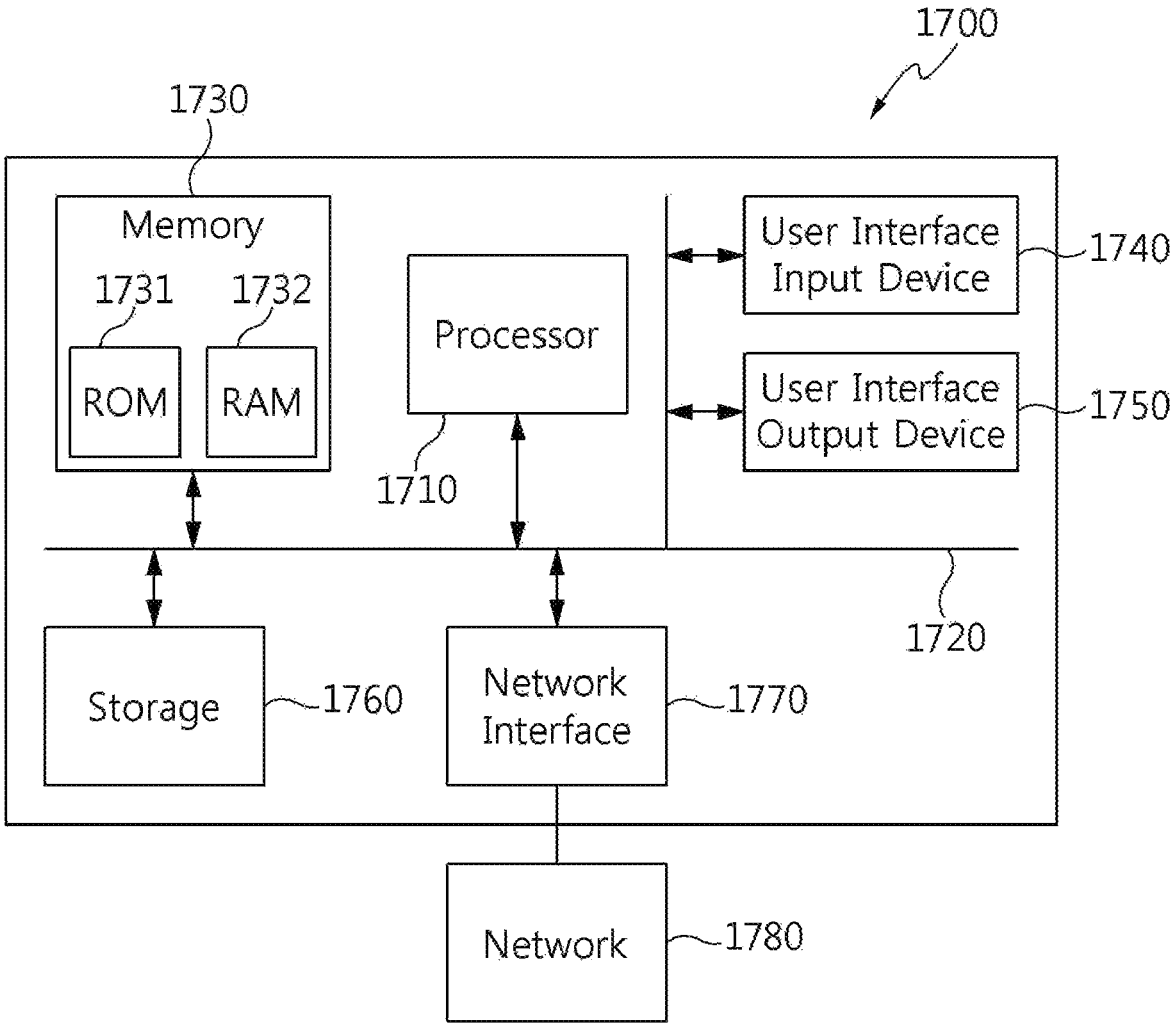
FIG. 17 is a block diagram that shows a computer system according to an embodiment of the present invention.

FIG. 17 is a block diagram that shows a computer system according to an embodiment of the present invention.

Referring to FIG. 17, the control unit 110 of the apparatus 100 for preventing an electronic device from recording may be implemented as a computer system 1700 including a computer-readable recording medium. As illustrated in FIG. 17, the computer system 1700 may include one or more processors 1710, memory 1730, a user-interface input device 1740, a user-interface output device 1750, and storage 1760, which communicate with each other via a bus 1720. Also, the computer system 1700 may further include a network interface 1770 connected to a network 1780. The processor 1710 may be a central processing unit or a semiconductor device for executing processing instructions stored in the memory 1730 or the storage 1760. The memory 1730 or the storage 1760 may be various types of volatile or nonvolatile storage media. For example, the memory may include ROM 1731 or RAM 1732.

Accordingly, an embodiment of the present invention may be implemented as a nonvolatile computer-readable storage medium in which methods implemented using a computer or instructions executable in a computer are recorded. When the computer-readable instructions are executed by a processor, the computer-readable instructions may perform a method according to at least one aspect of the present invention.

According to the present invention, a recording prevention signal is generated only in a narrow region, whereby an electronic device using a microphone may be prevented from recording while a user does not feel inconvenience.

Also, according to the present invention, an irregular and complex recording prevention signal is generated using a simple circuit structure, whereby an electronic device may be precluded from analyzing the recording prevention signal.

Also, according to the present invention, an ultrasound shadow region, which is a limitation of the conventional art, may be effectively eliminated.

Also, according to the present invention, unilateral recording that is not agreed upon between people who participate in a meeting, telephone conversation, or conversation may be prevented.

As described above, the apparatus and method for preventing an electronic device from recording according to the present invention are not limitedly applied to the configurations and operations of the above-described embodiments, but all or some of the embodiments may be selectively combined and configured, so that the embodiments may be modified in various ways.

What is claimed is:

1. An apparatus for preventing an electronic device from recording, comprising:

a control unit for generating a first modulation signal, which is a noise signal source, and controlling respective components of the apparatus for generating an ultrasonic recording prevention signal;

a first modulation unit for modulating the first modulation signal to a frequency-modulated (FM) signal;

an ultrasonic signal generation unit for generating an ultrasonic signal, a frequency of which is adjusted in such a way that a value of at least one of a variable resistor and a variable capacitor changes depending on a magnitude of the FM signal;

an amplification unit for increasing or decreasing a magnitude of the generated ultrasonic signal;

a resonance unit for generating resonance and thereby increasing a voltage to be applied to a transducer; and an ultrasound output unit for converting an electrical signal into an ultrasonic signal using the transducer and radiating a recording prevention signal, which is converted into the ultrasonic signal, to a microphone of the electronic device.

2. The apparatus of claim 1, wherein the first modulation unit performs amplitude modulation (AM) based on information about a frequency of the first modulation signal and performs the frequency modulation based on information about an amplitude of the first modulation signal.

3. The apparatus of claim 2, wherein the resonance unit controls a magnitude of the amplitude modulation by adjusting at least one of a resistance of the resonance unit and a Q factor of a load of the resonance unit.

4. The apparatus of claim 1, wherein the first modulation signal is configured such that at least one of a frequency and an amplitude thereof has a random value.

5. The apparatus of claim 1, further comprising:

a second modulation unit for modulating a second modulation signal, input from the control unit, to a Pulse-Width Modulation (PWM) signal, the second modulation unit being disposed between the ultrasonic signal generation unit and the amplification unit.

6. The apparatus of claim 5, wherein the second modulation signal is configured such that at least one of a frequency and an amplitude thereof has a random value.

7. The apparatus of claim 1, further comprising:

a third modulation unit for generating airflow in order to modulate the recording prevention signal by generating a Doppler effect near the microphone of the electronic device.

8. The apparatus of claim 7, wherein the control unit controls the third modulation unit so as to generate the airflow such that at least one of a direction, a speed, and a strength thereof is randomly set.

9. The apparatus of claim 1, wherein the ultrasound output unit further comprises a guard including multiple poles for making a distance between the transducer and the microphone of the electronic device equal to or greater than a threshold distance, wherein, between the multiple poles of the guard, slits are formed, and the poles and the slits form at least one of a horizontal structure, a vertical structure, a cross structure, and a honeycomb structure.

10. The apparatus of claim 9, wherein the guard has a curved shape in order to prevent the microphone of the electronic device from coming into contact with the pole.

11. The apparatus of claim 1, further comprising:

a sensor unit for checking whether the electronic device is present using a sensor, wherein the control unit performs control such that the recording prevention signal is radiated to the microphone of the electronic device only when it is determined that the electronic device is present.

12. The apparatus of claim 11, wherein the sensor unit checks whether the electronic device is present using at least one of the transducer of the ultrasound output unit, a detector for detecting a leakage electromagnetic wave, a photodiode, and a pressure sensor.

13. The apparatus of claim 1, wherein the ultrasound output unit includes multiple ultrasound output modules disposed along multiple surfaces, and each of the ultrasound output modules, including one or more transducers, is operated by being associated with multiple channels.

14. The apparatus of claim 13, wherein, when the ultrasound output unit is configured with the multiple ultrasound output modules, the respective ultrasound output modules have different frequencies, different phases, different duty cycles, and different amplitudes, or the respective ultrasound output modules radiate the recording prevention signal, which is converted into the ultrasonic signal, in different directions.

15. The apparatus of claim 1, wherein, when the microphone is disposed at a backside of the electronic device, the control unit vibrates an upper substrate on which the electronic device is disposed, thereby incapacitating the microphone.

16. The apparatus of claim 1, wherein, in the ultrasound output unit, a first transducer and a second transducer adjacent thereto make a pair and operate, wherein the second transducer is associated with a channel that differs from a channel with which the first transducer is associated.

17. The apparatus of claim 16, wherein, in order to minimize a shadow region, the control unit changes a relative phase between the first transducer and the second transducer or changes a phase of the first transducer at preset intervals or at random intervals by setting a delay time.

18. The apparatus of claim 1, further comprising:

a protection circuit unit for voltage clamping in order to protect the transducer of the ultrasound output unit from overvoltage when a voltage equal to or greater than a threshold voltage is applied.

19. An apparatus for preventing an electronic device from recording, comprising:

an ultrasonic circuit for generating a recording prevention signal in order to prevent the electronic device from recording;

an ultrasound output unit for radiating the recording prevention signal in a form of an ultrasonic signal to the electronic device; and an air blower unit for generating airflow near a microphone of the electronic device in order to modulate the recording prevention signal, wherein the ultrasound output unit comprises:

a transducer for converting the recording prevention signal from an electrical signal into the ultrasonic signal;

an output module for radiating the converted recording prevention signal to the microphone of the electronic device; and a guard configured with multiple poles and multiple slits and disposed between the transducer and the electronic device.

20. A method for preventing an electronic device from recording, performed by an apparatus for preventing an electronic device from recording, comprising:

generating a noise signal source;

performing frequency modulation by controlling a value of at least one of a variable resistor and a variable capacitor based on information about an amplitude of the noise signal source;

performing amplitude modulation by controlling a resistance value of a resonance unit based on information about a frequency of the noise signal source;

converting a result of the frequency modulation and the amplitude modulation into a recording prevention signal in a form of an ultrasonic signal using a transducer; and radiating the converted recording prevention signal to a microphone of the electronic device.

* * * * *